US007786943B2

(12) United States Patent
Deguchi

(10) Patent No.: US 7,786,943 B2
(45) Date of Patent: Aug. 31, 2010

(54) ANTENNA DEVICE AND RADIO COMMUNICATION SYSTEM

(75) Inventor: Futoshi Deguchi, Fukuoka (JP)

(73) Assignee: Panasonic Corporation, Osaka (JP)

( * ) Notice: Subject to any disclaimer, the term of this patent is extended or adjusted under 35 U.S.C. 154(b) by 119 days.

(21) Appl. No.: 12/179,095

(22) Filed: Jul. 24, 2008

(65) Prior Publication Data

US 2009/0027285 A1 Jan. 29, 2009

(30) Foreign Application Priority Data

Jul. 27, 2007 (JP) ..... 2007-195390

(51) Int. Cl.
*H01Q 11/12* (2006.01)
*H01Q 19/10* (2006.01)
*H01Q 1/36* (2006.01)

(52) U.S. Cl. ..... 343/742; 343/818; 343/895

(58) Field of Classification Search ..... 343/742, 343/818, 866, 895; 340/572.7
See application file for complete search history.

(56) References Cited

U.S. PATENT DOCUMENTS

| | | | | |
|---|---|---|---|---|
| 7,173,567 | B2 * | 2/2007 | Inatsugu et al. | 343/702 |
| 7,474,272 | B2 * | 1/2009 | Lamoureux et al. | 343/895 |
| 2005/0134515 | A1 * | 6/2005 | Copeland et al. | 343/788 |
| 2007/0159333 | A1 | 7/2007 | Deguchi | |

FOREIGN PATENT DOCUMENTS

| | | | |
|---|---|---|---|
| JP | 2007-043535 | A | 2/2007 |
| JP | 2007-164479 | A | 6/2007 |

OTHER PUBLICATIONS

English language Abstract of JP 2007-164479 A, Jun. 28, 2007.
English language Abstract of JP 2007-043535 A, Feb. 15, 2007.

* cited by examiner

*Primary Examiner*—Shih-Chao Chen
(74) *Attorney, Agent, or Firm*—Greenblum & Bernstein P.L.C.

(57) ABSTRACT

An antenna device includes: a substrate; first and a second antenna units which are wound coaxially on a surface of the substrate, and include a plurality of antenna elements; and a feeder which feeds power only to the first antenna unit. A separation distance between the antenna elements in each of the first and second antenna units is substantially the same.

17 Claims, 5 Drawing Sheets

ANTENNA DEVICE AND RADIO COMMUNICATION SYSTEM

BACKGROUND

1. Technical Field

The present invention relates to an antenna device for an RF-ID reader/writer communicating with a plurality of RF-ID tags by using the frequency in the HF band (13.56 MHz band) and a radio communication system using the antenna device.

2. Background Art

In the related art, a circular or rectangular single-winding or multi-winding loop antenna including antenna elements generally arranged in the same plane has been put in practical use as an antenna for an RF-ID reader/writer using the frequency in the HF band (13.56 MHz band).

The loop antenna for an RF-ID reader/writer has largest magnetic field intensity in a direction perpendicular to its opening surface S (direction of center axis). Thus, a loop antenna on the side of an RF-ID tag and a loop antenna for an RF-ID reader/writer are generally arranged so that respective opening surfaces S will be parallel to each other.

For communications with a plurality of RF-ID tags, a plurality of RF-ID tags are arranged in the same plane so that the opening surfaces S will not overlap each other and the opening surfaces S will be parallel to the loop antenna for an RD-ID reader/writer.

In an application where articles each having an extremely small thickness are managed, such as a book management application or a CD/DVD management application, an RF-ID tag cannot be affixed to the spine of a book or a CD/DVD case due to the size of the RF-ID Tag and the physical thickness of the article. As a solution to this problem, a plurality of RF-ID tags have been unavoidably affixed to the front cover or back cover of a target article with narrow intervals (thinness of the article plus $\alpha$) in an overlapping fashion so that the center axes of tag antennas will be aligned to each other.

In communications with a plurality of RF-ID tags arranged in an overlapping fashion by using a circular or rectangular single-winding or multi-winding loop antenna including antenna elements generally arranged in the same plane, there arises problems including deviations of the antenna resonant frequency due to interference between tags or interference between a tag and the antenna for an reader/writer, or distance attenuation of the magnetic field intensity as a fundamental problem. As a result, since an extremely small number of tags that are read out, communications with all tags are unavailable.

A multi-winding loop antenna described in JP-A-2007-164479 as a solution to this will be described. FIG. 5A is a side view of the main structure of a related art antenna device. FIG. 5B shows distribution of the magnetic field intensity at a distance of a constant height above the outer peripheral side surface in the related art example. In FIG. 5A, a feed element part 11 as a first antenna unit and a parasitic element part 12 as a second antenna unit are electrically grounded at opposed parts thereof to a conductor plate 8 via a grounding metallic pin 13.

The feed element part 11 as the first antenna unit is composed of a multi (n-) winding loop antenna. The initial winding end of a loop is connected to the grounding metallic pin 13. The final winding end of the loop is connected to the resonant/matching circuit. A radiofrequency power is supplied from a reader/writer via a coaxial cable.

The parasitic element part 12 as the second antenna unit is composed of a single-winding loop antenna. The initial winding end of a loop is connected to the grounding metallic pin 13. The final winding end of the loop is connected to the resonant/matching circuit. The loop antenna resonates with a desired frequency and is connected to a matching load (not shown). The magnetic field distribution Hx obtained with this arrangement is shown in FIG. 5B.

The number of elements in the parasitic element part 12 as the second antenna unit is imbalanced compared with the feed element part 11 as the first antenna unit. The magnetic field distribution of the magnetic field Hx in the direction of antenna length (X-axis direction) is imbalanced as shown in FIG. 5B. In this case, it is understood that the magnetic field Hx near the parasitic element part and the first element part of the feed element part ((1) in FIG. 5B) is higher than that of the remaining feed element part.

While a magnetic field intensity above the minimum operation magnetic field Hx (min) of a tag is supplied in communications with a plurality of tags, the magnetic field Hx near the parasitic element part and the first element part of the feed element part ((1) in FIG. 5B) is unnecessarily high, thus reducing the use efficiency of transmit power supplied from the reader/writer.

As described above, in the related art, the number of elements in the parasitic element part as the second antenna unit is imbalanced compared with the feed element part as the first antenna unit. The magnetic field intensity distribution shows an eminent unevenness in part, which reduces the use efficiency of transmit power supplied from the reader/writer.

SUMMARY

An object of the invention is to provide an antenna device for an RF-ID reader/writer capable of enhancing the use efficiency of transmit power and a radio communication device using the antenna device.

There is provided an antenna device including: a substrate; first and a second antenna units which are wound coaxially on a surface of the substrate, and include a plurality of antenna elements; and a feeder which feeds power only to the first antenna unit, wherein a separation distance between the antenna elements in each of the first and second antenna units is substantially the same.

With this configuration, in case an antenna is installed on a metallic shelf or a wooden shelf, there is no influence of the material of the shelf plate and adjustment of antenna impedance is unnecessary. This offers convenience in the installation work and provides excellent communications with a plurality of RF-ID tags arranged with narrow intervals in an overlapping fashion as well as improves the use efficiency of transmit power by making uniform the magnetic field distribution.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION

The antenna device for an RF-ID reader/writer according to the invention includes: a substrate having an almost rectangular shape at least the surface of which is composed of an insulating material; a plurality of antenna elements wound on the surface of the substrate in a direction orthogonal to the longitudinal direction of the substrate and electrically coupled to each other; and a feeder electrically coupled to the antenna elements and feeding power thereto. The antenna elements are divided into a first antenna unit receiving power from the feeder and a second antenna unit not receiving power from the feeder and the second antenna unit activates an antenna function when the first antenna unit receives power from the feeder, with a separation distance between antenna elements in the first and second antenna unit being almost the same.

With this configuration, it is possible to improve the use efficiency of transmit power by making uniform the magnetic field distribution.

Next, the antenna device according to Embodiment 1 of the invention will be detailed.

Embodiment 1

Figure 1:
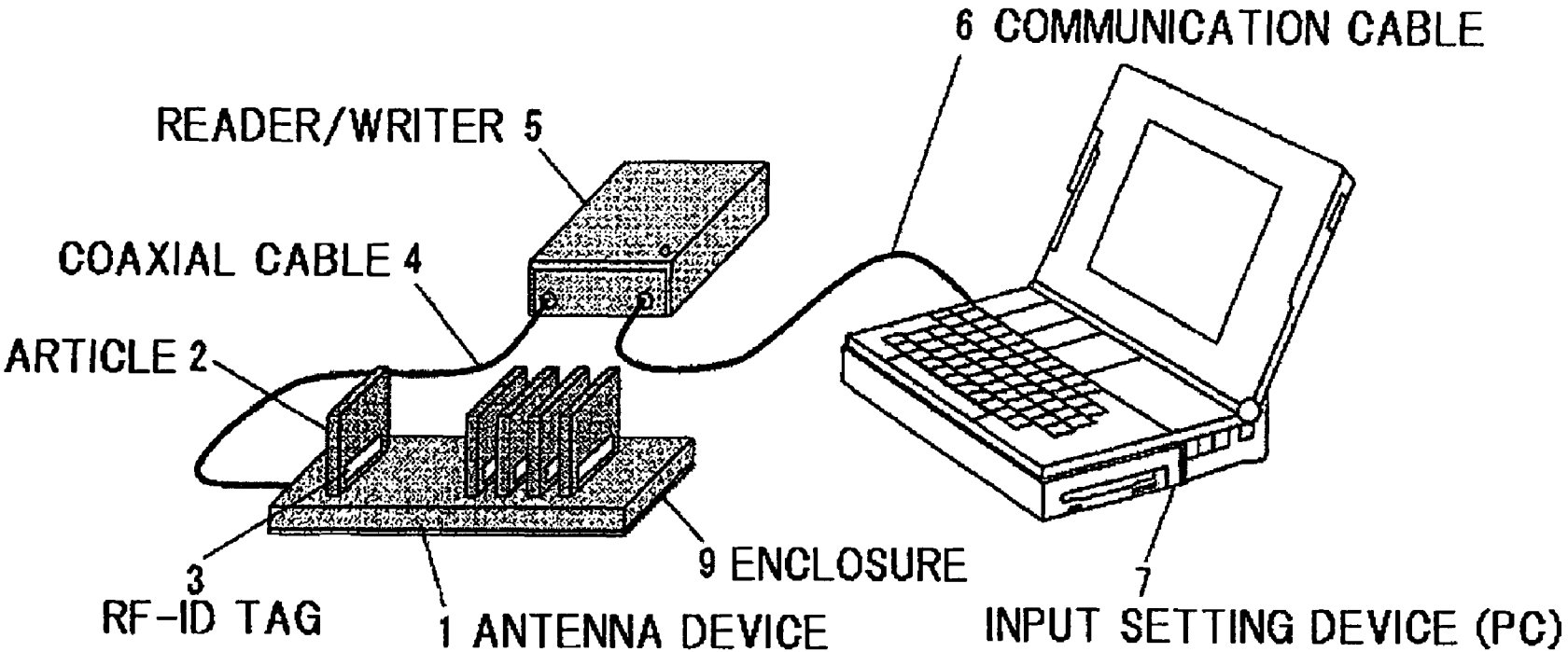
FIG. 1 is a perspective view of a radio communication system according to Embodiment 1.

FIG. 1 is a perspective view of a radio communication system according to Embodiment 1 of the invention. In FIG. 1, an antenna device 1, an article 2, an RF-ID tag 3, and a coaxial cable 4 are provided. Further, a reader/writer 5, a communication cable 6, and an input setting device (PC) 7 are provided.

Figure 2:
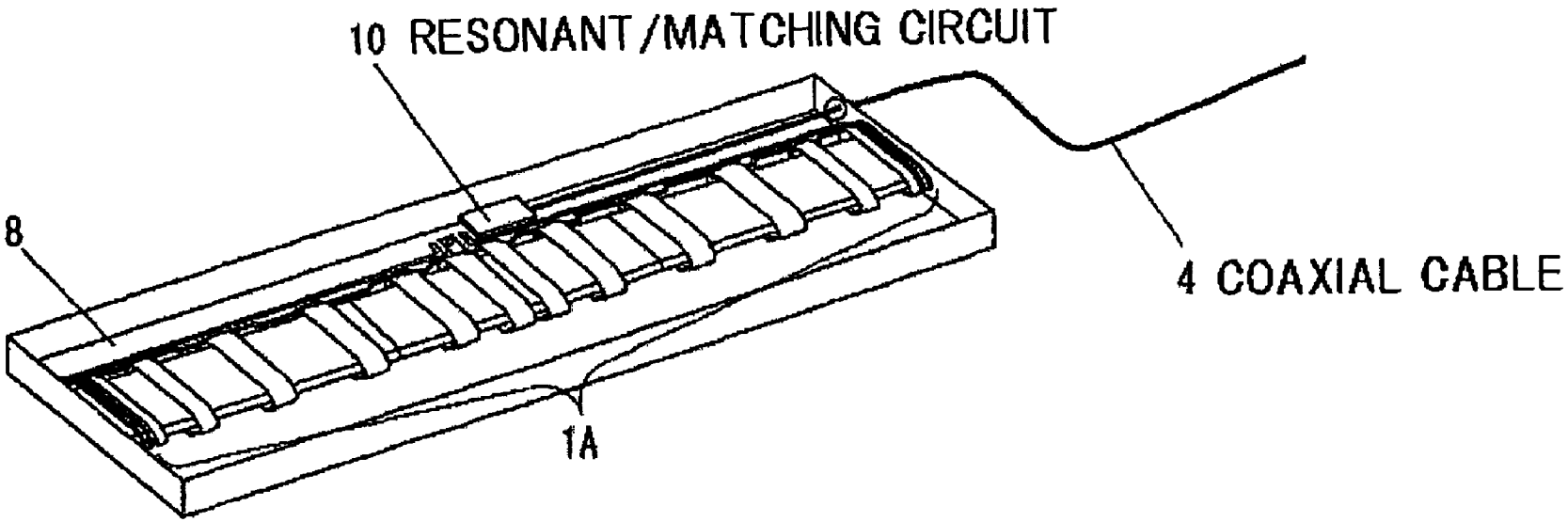
FIG. 2 is a perspective view of an antenna device for an RF-ID reader/writer according to Embodiment 1.

FIG. 2 is a perspective view of the antenna device 1 according to this embodiment with a lid of a housing removed. As shown in FIG. 2, a grounding conductor plate 8 and a multi-winding loop antenna 1A constituting a ground-type multi-winding loop antenna form an antenna for an RF reader/writer device and are accommodated in a resin housing 9. The multi-winding loop antenna 1A is connected to the reader/writer (radio communication device) 5 via a resonance/matching circuit 10 and a coaxial cable 4.

The multi-winding loop antenna 1A connected to the reader/writer (radio communication device) 5 supplies power and transmit data to the plurality of RF-ID tags 3 each including an antenna on the tag side (not shown) by way of magnetic induction and acquires receive data from the RF-ID tags (wireless tags) 3 by way of load change.

As shown in FIG. 1, a plurality of RF-ID tags 3 are arranged with narrow intervals in almost a linear shape on the outer periphery side surface of the ground-type multi-winding loop antenna device 1.

With this arrangement, it is possible to perform communications with all RF-ID tags 3 on the outer periphery side surface of the ground-type multi-winding loop antenna 1A.

In this embodiment, the ground-type multi-winding loop antenna 1A is used as an antenna for an RF-ID reader/writer, thus favorably performing communications with a plurality of RF-ID tags 3 arranged with narrow intervals in an overlapping fashion.

The ground-type multi-winding loop antenna according to this embodiment will be further detailed.

Illustrated is an antenna device for an RF-ID reader/writer according to Embodiment 1.

Figure 3A:
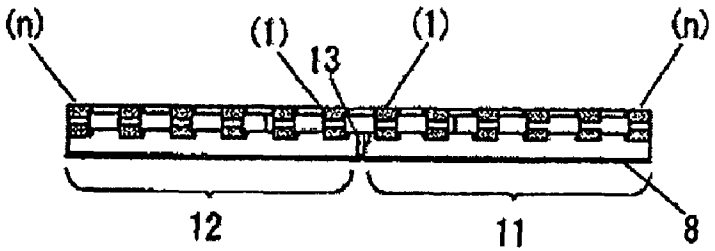
FIG. 3A shows an antenna device for an RF-ID reader/writer according to Embodiment 1.

In FIG. 3A, a feed element part 11 as a first antenna unit and a parasitic antenna 12 as a second antenna unit are electrically grounded at opposed parts thereof to a grounding conductor plate 8 via a grounding metallic pin 13.

The detailed structure of the portions of the feed element part 11 and the parasitic element part 12 to be connected to the grounding conductor plate 8 is disclosed especially in FIGS. 4 and 7 of JP-A-2007-164479.

The feed element part 11 as the first antenna unit includes a multi (n-) winding loop antenna. The initial winding end of a loop is connected to the grounding metallic pin 13. The final winding end of the loop is connected to the resonant/matching circuit 10. A high frequency power is supplied from a reader/writer 5 via a coaxial cable 4.

Figure 3B:
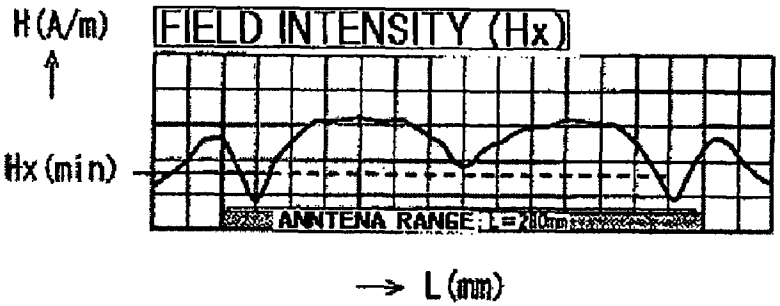
FIG. 3B shows a magnetic field distribution in the antenna device according to Embodiment 1.

The parasitic element part 12 as the second antenna unit includes a multi (n-) winding loop antenna. The initial winding end of a loop is connected to the grounding metallic pin 13. The final winding end of the loop is connected to the resonant/matching circuit 10. The loop antenna resonates with a desired frequency and is connected to a matching load (not shown). The magnetic field distribution Hx obtained with this arrangement is shown in FIG. 3B.

The first and second antenna unit 11, 12 is an antenna device characterized in that a separation distance between antenna elements is almost the same and that the arrangement of the corresponding antenna elements in the first and second antenna unit 11, 12 is almost symmetrical about the coupling position of both antennas.

Balance is provided between the number of elements in the feed element part 11 as the first antenna unit and that of the parasitic element part 12 as the second antenna unit. The magnetic field distribution of the magnetic field Hx in the direction of antenna length (X-axis direction) keeps a horizontal balance thus dramatically improving the use efficiency of transmit power supplied from the reader/writer.

The feed element part 11 and the parasitic element part 12 form a loop antenna on the conductor plate 8 in opposite directions about the conductor plate 8, that is, with the winding direction reversed. This activates the parasitic element part 12 when power is supplied to the feed element part 11. The feed element part 11 and the parasitic element part 12 may be symmetrically formed with respect to the conductor plate 8.

In this embodiment, the feed element part 11 and the parasitic element part 12 are formed by a loop antenna having a width of 10 mm.

Embodiment 2

Next, the antenna device according to Embodiment 2 of the invention will be detailed.

An antenna device according to Embodiment 2 is designed to couple to the reader/writer according to Embodiment 1 so that the same drawings are shared.

Figure 3C:
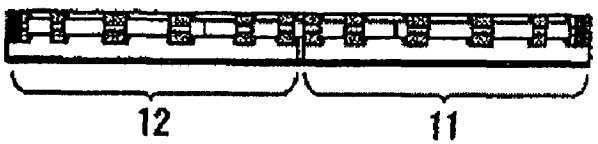
FIG. 3C shows an antenna device for an RF-ID reader/writer according to Embodiment 2.

FIG. 3C shows an antenna device for an RF-ID reader/writer according to Embodiment 2 of the invention. In FIG. 3C, a feed element part 11 as a first antenna unit and a parasitic element part 12 as a second antenna unit are electrically grounded at opposed parts thereof to a conductor plate 8 via a grounding metallic pin 13.

The feed element part 11 as the first antenna unit includes a multi (n-) winding loop antenna. The initial winding end of a loop is connected to the grounding metallic pin 13. The final winding end of the loop is connected to the resonant/matching circuit 10. A high frequency power is supplied from a reader/writer 5 via a coaxial cable 4.

Figure 3D:
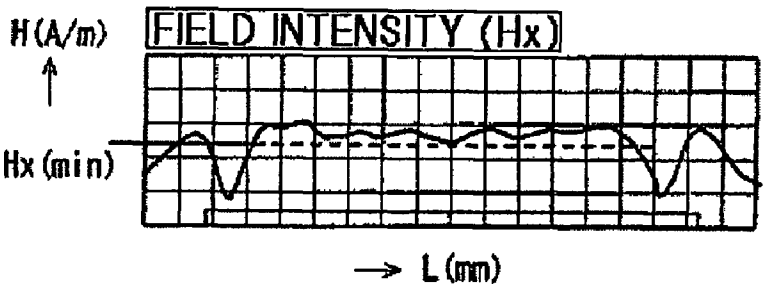
FIG. 3D shows a magnetic field distribution in the antenna device according to Embodiment 2.

The parasitic element part 12 as the second antenna unit includes a multi (n-) winding loop antenna. The initial winding end of a loop is connected to the grounding metallic pin 13. The final winding end of the loop is connected to the resonant/matching circuit 10. The loop antenna resonates with a desired frequency and is connected to a matching load (not shown). The magnetic field distribution Hx obtained with this arrangement is shown in FIG. 3D.

Figures 4A, 4B, 4C, 4D, 4E:
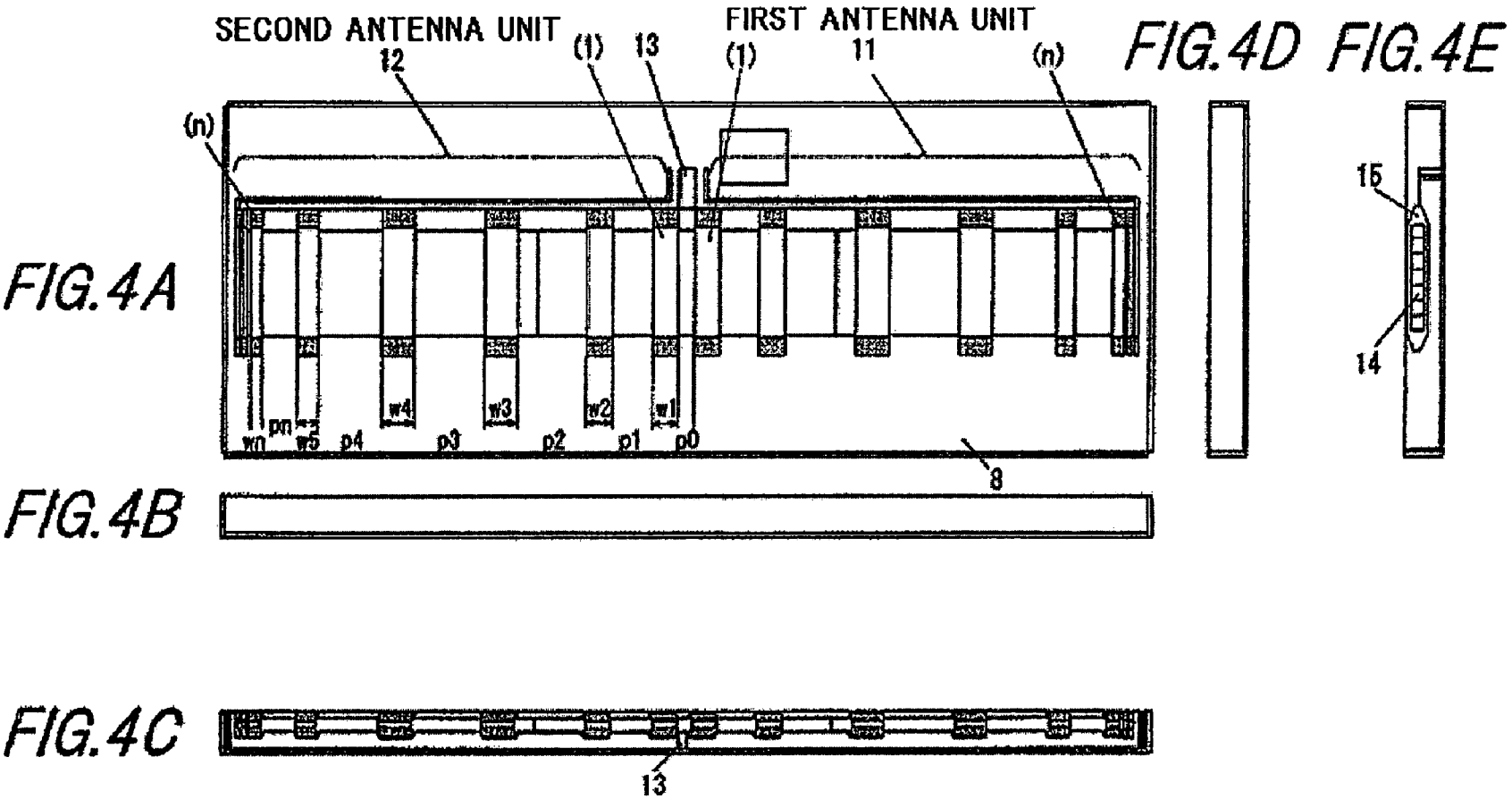
FIGS. 4A to 4E are detailed explanatory drawings of an antenna device for an RF-ID reader/writer according to Embodiment 2.
Figure 5A:
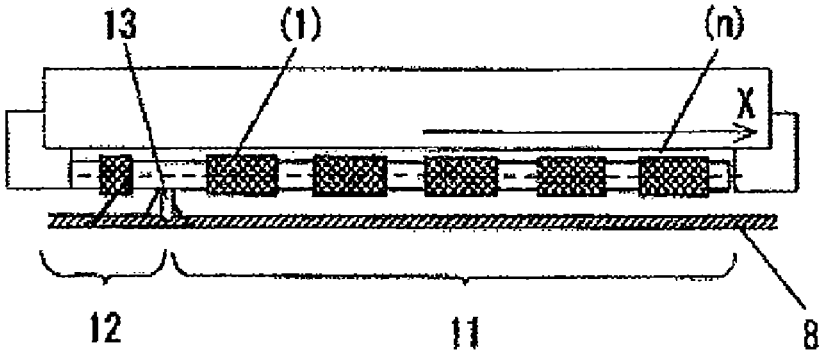
PRIOR ART FIG. 5A
FIG. 5A is an explanatory drawing of an antenna device for an RF-ID reader/writer according to the related art.
Figure 5B:
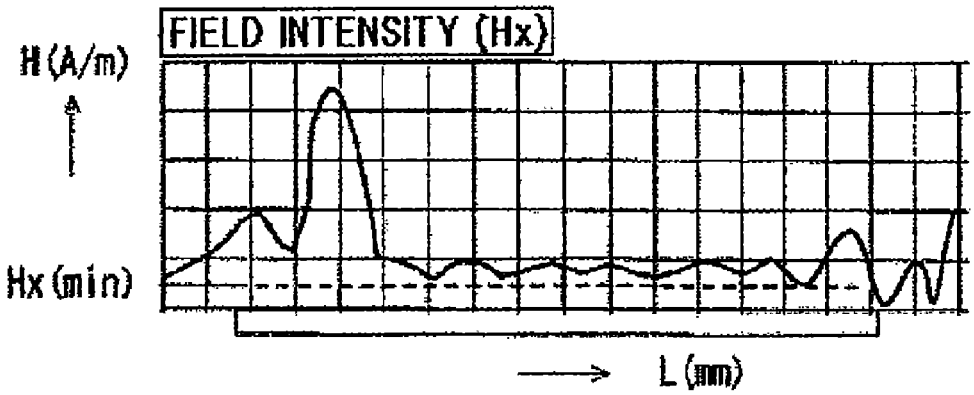
PRIOR ART FIG. 5B
FIG. 5B shows a magnetic field distribution in the antenna device according to the related art.

FIGS. 4A to 4E show detailed views of the antenna device according to Embodiment 2. FIG. 4A is a plan view of the antenna device with lid of the housing removed, FIG. 4B is a front view thereof, and FIG. 4D is a side view thereof. FIG. 4C shows a partial front cross section. FIG. 4E shows a partial side cross section.

The separation distance (p0) between an antenna element in the first antenna unit 11 and an antenna element in the second antenna unit 12 that are closest to each other is made shorter than a separation distance (p1 to pn) between antenna elements in the first and second antenna unit 11, 12. This arrangement makes it possible to control the current distribution of a high-frequency current flowing through the elements.

Further, a separation distance between antenna elements in the first and second antenna unit 11, 12 is shorter at the end (p1, pn) respectively than in the center (p3). This arrangement makes it possible to control the current distribution of a high-frequency current flowing through the elements.

Further, a separation distance (p1 to pn) between antenna elements in the first and second antenna unit 11, 12 respectively are gradually made shorter from the center to the end. This arrangement makes it possible to control the current distribution of a high-frequency current flowing through the elements. Further, the arrangement of the antenna elements in the first and second antenna unit 11, 12 is almost symmetrical about the coupling position of both antennas, thereby providing a horizontal balance.

Further, the separation distance (p0) between an antenna element in the first antenna unit 11 and an antenna element in the second antenna unit 12 that are closest to each other is made shorter than a separation distance (p1, pn) between antenna elements in the first and second antenna unit 11, 12 at the end thereof. This arrangement makes it possible to control the current distribution of a high-frequency current flowing through the elements.

Further, an antenna element width (w1 to wn) in the first and second antenna unit 11, 12 is large (w3) at an antenna located in the center and small at one located at the end (w1, wn) respectively. This arrangement makes it possible to control the current distribution of a high-frequency current flowing through the elements.

Further, the first antenna unit 11 and the second antenna unit 12 are electrically grounded to the grounding conductor plate 8 by way of a common connecting member (grounding metallic pin 13) between the antenna elements that are closest to each other. In case the antenna is installed on a wooden shelf or a metallic shelf to communicate with a tag affixed to an article, there is no influence of the material of the shelf plate and adjustment of antenna impedance in installation is unnecessary. This dramatically improves convenience in the installation work.

As described above, through optimum selection of an element width (w) of each antenna element and a separation distance (p) between elements, it is made possible to control the current distribution of a high-frequency current flowing through the antenna elements. Through control of the current distribution of a high-frequency current flowing through the antenna elements in the feed element part 11 as the first antenna unit and the parasitic element part 12 as the second antenna unit, the magnetic field distribution of the magnetic field Hx in the direction of antenna length (X-axis direction) maintains a horizontal balance and shows uniform distribution of magnetic field intensity as shown in FIG. 3D. This dramatically improves the use efficiency of transmit power supplied from the reader/writer.

In other words, the current density in the center of the feed element part 11 is decreased while the current density at the end is increased in order to make substantially uniform the magnetic field intensity of the feed element part 11.

The antenna device for an RF-ID reader/writer and a radio communication device using the antenna device according to the invention are also applicable to an antenna for an RF-ID reader/writer for communicating with a plurality of RF-ID tags by using the HF band (13.56 MHz band) that requires a wide tag reading range of a plurality of tags overlapped with narrow intervals, an RF-ID reader/writer and an RF-ID system using the antenna.

This application is based upon and claims the benefit of priority of Japanese Patent Application No. 2007-195390 filed on Jul. 27, 2007, the contents of which are incorporated herein by reference in its entirety.

What is claimed is:

1. An antenna device, comprising:

a substrate;

first and a second antenna units which are spirally wound coaxially around a surface of the substrate, and include a plurality of antenna elements; and a feeder which feeds power only to the first antenna unit, wherein the antenna elements in the first and second antenna units are arranged substantially symmetrically with respect to a coupling position of the first and second antenna units, wherein a separation distance between the antenna elements in each of the first and second antenna units is substantially the same.

2. The antenna device according to claim 1, wherein the first and second antenna units are grounded with a ground plate.

3. The antenna device according to claim 2, wherein the first and second antenna units are symmetrically arranged with respect to the ground plate.

4. The antenna device according to claim 1, wherein the substrate is insulated at least on the surface thereof.

5. A radio communication system, wherein information from a wireless tag is acquired by using the antenna device according to claim 1, and wherein the information of the wireless tag acquired from the antenna device is received to decode the information.

6. An antenna device, comprising:

a substrate;

first and second antenna units which are wound coaxially on a surface of the substrate, and include a plurality of antenna elements; and a feeder which feeds power only to the first antenna unit, wherein a separation distance between the antenna elements in each of the first and second antenna units is substantially the same, wherein a separation distance between an antenna element in the first antenna unit and an antenna element in the second antenna unit that are closest to each other is shorter than the separation distance between the antenna elements in each of the first and second antenna units.

7. An antenna device, comprising:

a substrate;

first and a second antenna units which are wound coaxially on a surface of the substrate, and include a plurality of antenna elements; and a feeder which feeds power only to the first antenna unit, wherein a separation distance between the antenna elements in each of the first and second antenna units is shorter at an end than in a center of each of the first and second antenna units.

8. The antenna device according to claim 7, wherein the separation distance between the antenna elements in each of the first and second antenna units are gradually made shorter from the center to the end of each of the first and second antenna units.

9. The antenna device according to claim 7, wherein an arrangement of the corresponding antenna elements in the first and second antenna units is substantially symmetrical about a coupling position of the first and second antenna units.

10. The antenna device according to claim 7, wherein a separation distance between an antenna element in the first antenna unit and an antenna element in the second antenna unit that are closest to each other is shorter than a separation distance between the antenna elements in each of the first and second antenna units.

11. The antenna device according to claim 7, wherein an antenna element width in each of the first and second antenna units is larger in the center than at the end of each of the first and second antenna units.

12. The antenna device according to claim 7, wherein the first and second antenna units are grounded with a ground plate between an antenna element in the first antenna unit and an antenna element in the second antenna unit that are closest to each other.

13. The antenna device according to claim 12, wherein the first and second antenna units are symmetrically formed with respect to the ground plate.

14. A radio communication system, wherein information from a wireless tag is acquired by using the antenna device according to claim 7, and wherein information of the wireless tag acquired from the antenna device is received to decode the information.

15. An antenna device, comprising:

a substrate;

first and second antenna units which are spirally wound coaxially around a surface of the substrate, and include a plurality of antenna elements; and a feeder which feeds power only to the first antenna unit, wherein the antenna elements in the first and second antenna units are arranged substantially symmetrically with respect to a coupling position of the first and second antenna units, wherein the first and second antenna units are arranged so that a magnetic field intensity provided by the first antenna unit is substantially equal to a field intensity provided by second antenna units.

16. The antenna device according to claim 15, wherein the first and second antenna units are grounded with a ground plate as a common connecting member.

17. An antenna device, comprising:

a substrate;

first and second antenna units which are spirally wound coaxially around a surface of the substrate, and include a plurality of antenna elements; and a feeder which feeds power only to the first antenna unit, wherein the antenna elements in the first and second antenna units are arranged substantially symmetrically with respect to a coupling position of the first and second antenna units.

* * * * *